United States Patent [19]

Enga

[11] 4,285,665

[45] Aug. 25, 1981

[54] ENGINES

[75] Inventor: Bernard E. Enga, Maidenhead, England

[73] Assignee: Johnson, Matthey & Co., Limited, London, England

[21] Appl. No.: 35,828

[22] Filed: May 4, 1979

[30] Foreign Application Priority Data

May 8, 1978 [GB] United Kingdom ..... 18238/78

[51] Int. Cl.[3] ..... F23D 13/12; F01B 29/10

[52] U.S. Cl. ..... 431/328; 60/517

[58] Field of Search ..... 431/328.7, 170, 326; 60/517; 126/92 AC

[56] References Cited

U.S. PATENT DOCUMENTS

| | | | |
|---|---|---|---|
| 1,325,456 | 12/1919 | Vest | 431/170 |
| 1,720,757 | 7/1929 | Blanchard | 431/7 |
| 3,801,212 | 4/1974 | Cutler | 431/328 X |
| 3,857,668 | 12/1974 | Koch | 431/328 X |
| 3,942,324 | 3/1976 | Johansson et al. | 60/517 |

FOREIGN PATENT DOCUMENTS

| | | | |
|---|---|---|---|
| 2342741 | 3/1974 | Fed. Rep. of Germany | 60/517 |

*Primary Examiner*—Samuel Scott
*Assistant Examiner*—Randall L. Green
*Attorney, Agent, or Firm*—Cushman, Darby & Cushman

[57] ABSTRACT

This invention relates to Stirling engines and to improved methods of operation whereby catalytic oxidation of a major proportion of the fuel takes place in the external combustor.

An external combustion unit of a Stirling engine comprises a catalytic combustor having a thermally stable and oxidation resistant monolith made from and/or carrying a catalytic material and including a multiciplity of flow paths for catalytic combustion of combustible gases and injected fuel.

The use of a catalytic combuster in accordance with this invention enables a Stirling or other engine fitted therewith to be used in areas such as mines and underwater installations where conventional flame combustion is impracticable or is controlled by stringent regulations.

7 Claims, 1 Drawing Figure

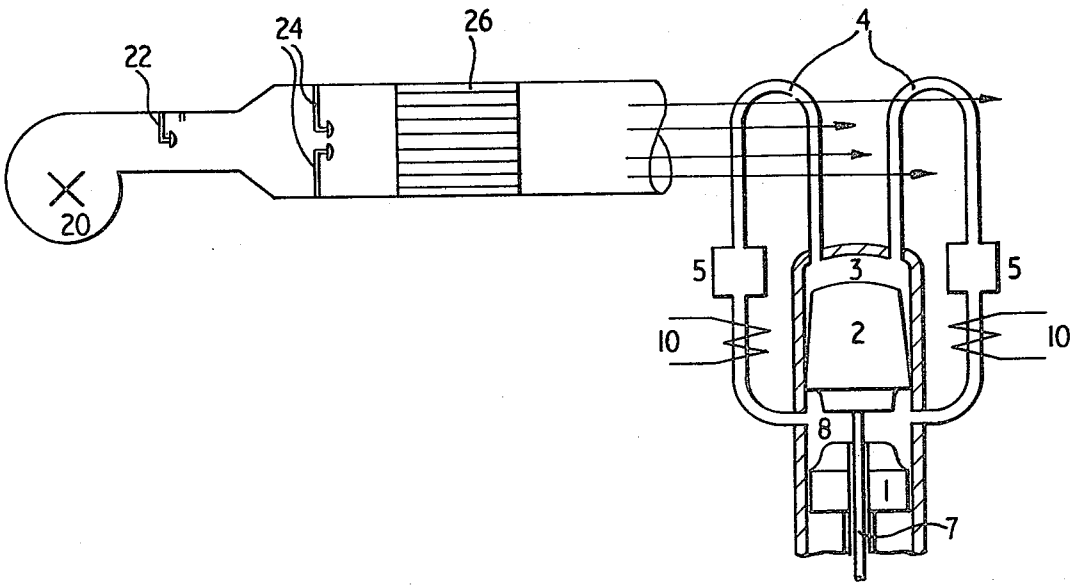
4
5
5
10
10
3
2
1
8
7
26
24
22
20

ENGINES

BACKGROUND AND SUMMARY OF THE INVENTION

This invention relates to Stirling engines and to improved methods of operation whereby catalytic oxidation of a major proportion of the fuel takes place in the external combustor.

The Stirling engine when connected to a rhombic or similar drive mechanism is known to possess very little vibration and this results in quiet operation of the engine. Since the fuel is burnt in an external combustor, the exhaust gases are cleaner than a normal diesel or petrol engine.

An object of the present invention is to provide a Stirling engine in which the external combustion unit is a catalytic combustor, such that the engine may be used in conditions where there are limits on noise, pollutants, in exhaust gases and flamable substances.

According to one aspect of the present invention there is provided an external combustion unit of a Stirling engine the unit comprising a catalytic combustor having a thermally stable and oxidation resistant monolith made from and/or carrying a catalytic material and including a multiplicity of flow paths for catalytic combustion of combustible gases and injected fuel.

Using catalytic combustion in the external combustion unit according to the invention enables the engine to be used in areas such as mines and under-water where conventional flame combustion is impractical or is controlled by stringent regulations.

According to another aspect of the present invention, the external combustion unit of the Stirling engine comprises:

(a) a fan for producing a supply of air to the combustor;

(b) a pilot burner fuelled by a fuel injector;

(c) at least one injector for injecting the remaining fuel into the gaseous stream;

(d) a catalytic combustor section comprising a temperature stable oxidation resistant monolith, the monolith providing catalytic channels for contact with and passage of the gases combined with injected fuel at stage (c) such that catalytic combustion of the uncombusted fuel takes place but in which a low pressure drop is produced, and (e) means for directing the stream of hot gaseous fluid leaving the catalytic combustor over heater pipes of the Stirling engine.

DETAILED DESCRIPTION OF THE INVENTION

In section (a) the temperature of the air is between 0° C. and 600° C. and at a pressure within the range 1 atmosphere to 20 atmospheres. In section (b), the pilot burner burns up to approximately 5% by weight of the total fuel consumption of the engine at full power. The proportion of the fuel utilised by the pilot burner during normal running may range from 0.16 by weight to 66⅔% by weight. The fuel injection for the pilot burner (b) is able to control the quantity of fuel and is adjusted primarily to give a temperature within a specific preferred range in the combustion section (d). A typical preferred temperature range in the combustion section is 200° C. to 500° C.

The remainder of the fuel is injected into the gaseous stream, in section (c), by one or more fuel injectors. The number of fuel injectors and their configuration will be dependent on the conditions of operation of the engine.

Preferably the oxidation resistant monolith in section (d) is metallic and is formed from one or more metals selected from the group comprising Ru, Rh, Pd, Ir, and Pt. However base metals, base metal alloys, or base metal alloys which also contain a platinum group metal component may be used.

The walls of the metallic monolith preferably have a thickness within the range 2–4 thousandths of one inch. The preferred characteristics of the metallic monolith having catalyst deposited thereon are (i) that it presents low resistence to the passage of gases by virtue of its possession of a high ratio of open area to blocked area and (ii) that it has a high surface to volume ratio.

A typical 200 cells per square inch ceramic monolith has walls 0.008–0.011 inches thick, a 71% open area and a 15% pressure drop. A typical 400 cells per square inch metallic monolith of the present invention has walls 0.002 inches thick, a 91–92% open area and a 4% pressure drop. A 200 cell per square inch metallic monolith has a 95% open area and a pressure drop of 4% or less.

Suitable platinum group metals for use in fabrication of the metallic monolith are platinum, 10% rhodium-platinum and dispersion strengthened platinum group metals and alloys as described in British Patent Specification Nos. 1,280,815 and 1,340,076 and U.S. Pat. Nos. 3,689,987, 3,696,502 and 3,709,667.

Suitable base metals which may be used are those capable of withstanding rigorous oxidising conditions. Examples of such base metal alloys are nickel and chromium alloys having an aggregate Ni plus Cr content greater than 20% by weight and alloys of iron including at least one of the elements chromium (3–40)wt.%, aluminum (1–10)wt.%, cobalt (0–5)wt.%, nickel (0–72)wt.% and carbon (0–0.5)wt.%. Such substrates are described in German OLS No. 2450664.

Other examples of base metal alloys capable of withstanding the rigorous conditions are iron-aluminium-chromium alloys which may also contain yttrium. The latter alloys may contain 0.5–12 wt.% Al, 0.1–3.0 wt.% Y, 0–20 wt.% Cr and balance Fe. These are described in U.S. Pat. No. 3,298,826. Another range of Fe-Cr-Al-Y alloys contain 0.5–4 wt.% Al, 0.5–3.0 wt.% Y, 20.0–95.0 wt.% Cr and balance Fe and these are described in U.S. Pat. No. 3,027,252.

Base metal alloys which also contain a platinum group metal component are useful as a catalytic metallic monolith in very fierce oxidising conditions. Such alloys are described in German DOS No. 2530245 and contain at least 40wt.% Ni or at least 40wt.% Co, a trace to 30wt.% Cr and a trace to 15wt.% of one or more of the metals Pt, Pd, Rh, Ir, Os and Ru. The alloys may also contain from a trace to the percentage specified or any one or more of the following elements:

| | % by weight |
|---|---|
| Co | 25 |
| Ti | 6 |
| Al | 7 |
| W | 20 |
| Mo | 20 |
| Hf | 2 |
| Mn | 2 |
| Si | 1.5 |
| V | 2.0 |
| Nb | 5 |
| B | 0.15 |

-continued

| | % by weight |
|---|---|
| C | 0.05 |
| Ta | 10 |
| Zr | 3 |
| Fe | 20 |
| Th and rare earth metals or oxides | 3 |

Where the metallic substrate is composed either substantially or solely of a platinum group metal it may be in the form of an interwoven wire gauze or mesh or corrugated sheet or foil. Where the metallic substrate is composed substantially of base metal it is preferably in the form of corrugated sheet or foil. These types of base metal monoliths are also described in German OLS No. 2450664 and they may be used in the combustor according to the present invention. Such base metal monoliths may have deposited thereon a first layer comprising an oxygen containing coating and a second and catalytic layer. The oxygen containing coating is usually present as an oxide selected from the group consisting of alumina, silica, titania, zirconia, hafnia, thoria, beryllia, magnesia, calcium oxide, strontium oxide, barium oxide, chromia, boria, scandium oxide, yttrium oxide and oxides of the lanthanides. Alternatively, the oxygen in the first layer is present as an oxygen containing anion selected from the group consisting of chromate, phosphate, silicate and nitrate. The second catalytic layer may, for example, comprise a metal selected from the groups consisting of Ru, Rh, Pd, Ir, Pt, Au, Ag, an alloy containing at least one of the said metals and alloys containing at least one of the said metals and a base metal. The first and second layers may be deposited or otherwise applied to the monolith as described in German OLS No. 2450664.

Alternative catalytic monoliths for use in section (f) may comprise structures wherein the catalyst is one comprising a metallic substrate having deposited thereon a surface coating consisting of one or more intermetallic compounds of the general formula $A_xB_y$ where A is selected from the group consisting of Al, Sc, Y, the lanthanides, Ti, Zr, Hf, V, Nb and Ta and x and y are integral and may have values of 1 or more, the surface coating of intermetallic compound being, preferably, in the form of a thin film ranging in thickness from 2 to 15 microns.

Many compounds of the type $A_xB_y$ are miscible with one another and structures in which the surface coatings deposited upon the said metallic substrate contains more than one compound of the type $A_xB_y$ are within the scope of this invention.

When the intermetallic compound is deposited in the form of a coating not more than 15 microns thick upon the surface of a metallic substrate, excessive brittleness, is absent and the coated substrate may be handled normally.

A number of different techniques may be employed to produce a coating in the form of a thin film of imtermetallic compound upon the surface of the metal metallic monolith. For example, aluminum may be deposited onto the surface of rhodium-platinum gauzes by a pack-aluminising process. In this process the gauzes are packed into a heat-resistant container in an appropriate mixture of chemicals such that aluminum is transferred via the vapour phase to the gauze surface. At the aluminising temperature, typically 800°-900° C., interaction between the platinum and aluminium occurs to give the required intermetallic compound.

Alternatively, chemical vapour deposition from $ZrCl_4$ can be used to form a layer of $Pt_3Zr$, or electrodeposition may be used either from aqueous or fused salt electrolysis to give the requisite compound.

Whichever method is adopted the objective is to form a layer of a firmly adherent, intermetallic compound on the wires of the gauze pack or other substrate.

In another technique, the metals forming the intermetallic compound are prepared as an appropriate solution in water or an organic solvent. The compound is caused to deposit upon the metallic substrate or gauze by the addition of a reducing agent. The metallic substrate is placed in the solution whilst the precipitation is taking place and becomes coated with a uniform, microcrystalline layer of the intermetallic compound.

The catalyst is preferably a metal selected from the group consisting of Ru, Rd, Pd, Ir, Pt and alloys of the said metals with each other and with one or more base metals such that at least 10% by weight of the said catalyst is PGM. Depending on the monolith and catalyst chosen an intermediate washcoat layer may be applied comprising a high surface area refractory metal oxide.

BRIEF DESCRIPTION OF THE DRAWING

The drawing diagrammatically illustrates a conventional Stirling engine modified according to the invention.

DETAILED DESCRIPTION OF THE DRAWING

The Stirling engine shown diagrammatically in the drawing and is conventionally composed of five major components: a power piston, 1, a displacer piston, 2, a heater (the catalytic combustor) shown to the left of the FIGURE a regenerator, 5, and a cooler, 10. The displacer piston 2 has a piston rod 7 which passes through the power piston 1, and a cold space 8 exists between the two pistons. Unlike a conventional internal combustion engine, the heat supply is external, the catalytic combustor, and the working medium is completely enclosed in the engine. The operation of the external combustor is as follows: a fan, 20, or similar apparatus such as a compressor provides the inlet of air which is heated by a pilot burner, 22. The supply of fuel to the pilot burner is adjusted for an optimum air temperature over the catalyst supported by the monolith. The remainder of the fuel is injected into the flow of hot air prior to the monolith, 26. Catalytic combustion of the fuel takes place. The hot exhaust gases indicated by arrows are used to heat the heater tubes 4 of the Stirling engine.

The fuel system and air supply may be driven by any convenient means which is best suited to the environment in which the engine is being operated. For example, if the invention was to be used in mines electrical drive motors would be used that were Buxton-certified flame-proof.

EXAMPLE

A test carried out using a Stirling engine fitted with a catalytic combustor according to the invention showed an increase in power output of 7% with the following exhaust emission levels:

hydrocarbons about 10 ppm.
carbon monoxide about 5 ppm.
$No_x$-zero.

The catalytic combustor monolith used had a catalyst diameter of 2 inches and a length of 3 inches and was made from an Fe-Cr-Al-Y alloy bearing a washcoat of aluminium with barium and a catalyst coating of platinum having a loading of 150 grams per cubic foot.

The inlet temperature of the catalyst was 210° C., the outlet temperature was 870° C., the fuel was propane and the Stirling engine had a rating of ⅔ BHP.

It is believed that the 7% improvement in power output when compared with the same engine using a conventional combustor, is due to the uniform heating of the heating tubes 4 to substantially the same maximum temperatures, namely, that of the hot exhaust gases from the combustor.

Although the invention has been described in relation to the Stirling engine, the underlying idea may also be used in connection with both reciprocal and rotary engines e.g. rotary engines having a high rotable piston and rotary engines having two intermeshing rotary abutment rotors.

I claim:

1. An external combustion unit of a Stirling engine which includes heater pipes comprising:

(a) a catalytic combustor;

(b) a pilot burner;

(c) means for supplying a stream of air to pass said pilot burner in order to heat said air;

(d) means for supplying fuel to said pilot burner;

(e) means for injecting additional fuel into the air stream after it has been heated by said pilot burner;

(f) means for passing the mixture of additional fuel and hot air to said catalytic combustor; and (g) means for directing the resulting stream of hot gases leaving the catalytic combustor over the heater pipes of the Stirling engine, said catalytic combustor comprising, a temperature stable oxidation resistant monolith which carries a catalyst and which provides catalytic channels for contact with and passage of the mixture of additional fuel and hot air such that catalytic combustion of the fuel takes place but in which a low pressure drop is produced, the monolith being metallic and having a catalyst supported thereon selected from the group consisting of ruthenium, rhodium, palladium, iridium, platinum and alloys of the said metals with each other and with one or more base metals in an amount such that at least 10% by weight of the catalyst is a platinum group metal.

2. A combustion unit according to claim 1 wherein the monolith is formed from one or more metals selected from the group comprising Ru, Rh, Pd, Ir and Pt.

3. A combustion unit according to claim 2 wherein the monolith is made from a 10% rhodium-platinum alloy.

4. A combustion unit according to claim 1 wherein the monolith is made from a base metal, a base metal alloy or a base metal alloy containing a platinum group metal.

5. A combustor according to claim 4 wherein the base metal alloy is a nickel-chromium alloy having an aggregate nickel plus chromium content greater than 20% by weight.

6. A combustor according to claim 4 wherein the base metal alloy consists essentially of at least one of the elements chromium (3–40)wt.%, aluminum (1–10)wt.%, cobalt (0–5)wt.%, nickel (0–72)wt.% and carbon (0–0.5)wt.%, balance iron.

7. A combustor according to claim 4 wherein the monolith is made from an alloy consisting of 0.5–12 wt.% Al, 0.1–3.0 wt.% Y, 0–20 wt.% Cr and balance Fe.

* * * * *